US011247118B2

(12) United States Patent
Ducard

(10) Patent No.: US 11,247,118 B2
(45) Date of Patent: Feb. 15, 2022

(54) MECHANICAL GAME ASSEMBLY SYSTEM AND METHOD

(71) Applicant: Malik Shabazz Ducard, Los Angeles, CA (US)

(72) Inventor: Malik Shabazz Ducard, Los Angeles, CA (US)

( * ) Notice: Subject to any disclaimer, the term of this patent is extended or adjusted under 35 U.S.C. 154(b) by 0 days.

(21) Appl. No.: 16/920,465

(22) Filed: Jul. 3, 2020

(65) Prior Publication Data

US 2022/0001267 A1 Jan. 6, 2022

(51) Int. Cl.
*A63F 3/00* (2006.01)
*A63F 7/00* (2006.01)

(52) U.S. Cl.
CPC ..... *A63F 3/00214* (2013.01); *A63F 3/00094* (2013.01); *A63F 7/0076* (2013.01); *A63F 2003/00223* (2013.01)

(58) Field of Classification Search
CPC ..... A63F 3/00214; A63F 3/00094; A63F 7/0076; A63F 2003/00223; A63F 7/04
See application file for complete search history.

(56) References Cited

U.S. PATENT DOCUMENTS 2,456,725 A * 12/1948 Netherton ..... A63F 7/02 273/120 R
3,069,805 A * 12/1962 Burrows ..... A63F 7/042 446/124
3,623,729 A * 11/1971 Wetherell ..... A63F 3/00214 273/241
4,875,687 A * 10/1989 Alsip ..... A63F 3/00094 273/241
6,394,452 B1 * 5/2002 Dunne ..... A63F 3/00094 273/241
6,568,679 B1 * 5/2003 Sommer ..... A63F 7/042 273/118 R
2005/0164758 A1 * 7/2005 Boeru ..... A63F 9/083 463/9

* cited by examiner

*Primary Examiner* — Michael D Dennis
(74) *Attorney, Agent, or Firm* — Cohen IP Law Group, P.C.; Michael N. Cohen

(57) ABSTRACT

A mechanical game assembly configured to provide the game of Tic Tac Toe is provided. The game assembly may include a first surface including openings forming a 3×3 grid, and a second surface including openings forming a 3×3 grid. The player makes a gameplay move by placing a player game piece in an opening on the first surface, and implements a corresponding game assembly move by placing an assembly game piece in an opening on the second surface.

18 Claims, 4 Drawing Sheets

MECHANICAL GAME ASSEMBLY SYSTEM AND METHOD

COPYRIGHT STATEMENT

This patent document contains material subject to copyright protection. The copyright owner has no objection to the reproduction of this patent document or any related materials in the files of the United States Patent and Trademark Office, but otherwise reserves all copyrights whatsoever.

FIELD OF THE INVENTION

This invention relates to interactive mechanical assemblies, including mechanical game assemblies providing games such as Tic Tac Toe.

BACKGROUND

Playing games is a fun activity enjoyed by children and adults throughout the world. A wide variety of games exist ranging from board games, electronic console games, sports games, single-player games, multi-player games and other types of games.

One of the oldest, simplest and most enjoyed games is the game of Tic Tac Toe. Tic Tac Toe is typically a paper-and-pencil game during which a first player is assigned to play "Xs" and the second player is assigned to play "Os", and the players take turns placing an X or an O in spaces within a 3×3 grid while attempting to place three in a row (horizontally, vertically or diagonally).

Single-player versions of the game are also available on computers or electronic gaming consoles during which the player plays against a computer. However, these versions of the game are much less enjoyable because the intrigue and mystery associated with playing Tic Tac Toe against a computer is somewhat low.

Accordingly, there is a need for a mechanical game assembly that provides the game of Tic Tac Toe to one or more players thereby providing a higher level of intrigue, mystery and entertainment.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF EXEMPLARY EMBODIMENTS

Figure 1:
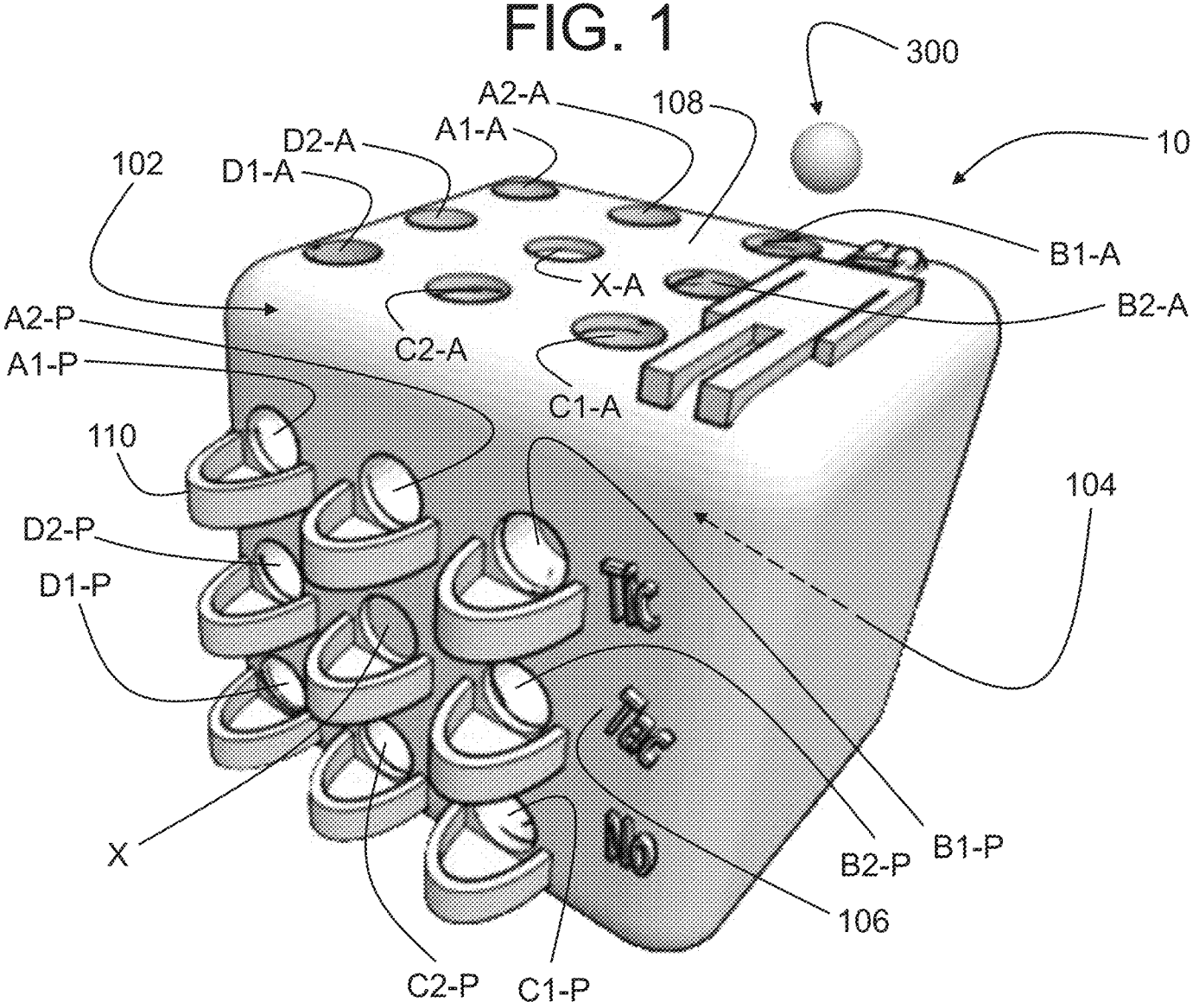
FIGS. 1-2 show aspects of a mechanical game assembly according to exemplary embodiments hereof.

In general, the assembly according to exemplary embodiments hereof provides a mechanical device that may be used as a game, puzzle or other type of interactive entertainment. The assembly may provide a mechanical platform with which one or more users may interact. In some embodiments, the assembly provides a mechanical gameplay platform (also referred to as a game box) that one or more players may interact with by taking gameplay turns ("making moves") in conjunction with gameplay turns or "moves" provided by the assembly. In some embodiments, the player and the assembly may take sequentially turns, e.g., the assembly may take the first turn followed by the player taking the second turn and so on (or vice versa). In some embodiments, the assembly may be utilized as a single-player device, and in other embodiments the assembly may be utilized as a multi-player device as will be described in other sections.

In one exemplary embodiment hereof, the assembly 10 may include a housing 100, a connection assembly 200 and one or more game pieces 300. In general, the connection assembly 200 is enclosed within the housing 100 and the game pieces 300 are used to make gameplay moves (or turns). The game pieces 300 may include balls of different colors, discs, coins or other types of game pieces. The assembly 10 may include other elements and/or components as necessary for it to fulfill its functionalities as described herein or otherwise.

As will be described herein, the connector assembly 200 may be designed, constructed and implemented to apply one or more gameplay algorithms to the game pieces 300 as the pieces 300 are played. For example, after a player may make a move using a first game piece 300, the connector assembly 200 may apply a specific algorithm to a second game piece during its next move to counter the player's move. In some embodiments, each algorithm implemented by the connector assembly 200 may be in direct response to a specific move made by the player.

For the purposes of this specification, the assembly 10 will be described in relation to the assembly 10 being utilized to provide the game of Tic Tac Toe. However, it will be understood by a person of ordinary skill in the art, upon reading this specification, that the assembly 10 may be utilized to provide other type(s) of games and that the scope of the assembly 10 is not limited in any way by the type(s) of games that it may be utilized to provide.

In one exemplary embodiment as shown in FIG. 1, the housing 100 may include a three-dimensional geometric form with an outer shell 102 defining an inner volume 104. The geometric form may include any type of form such as any type of polyhedron (e.g., a cube as shown, a hexahedron, etc.), cylinders, spheres, ellipsoids, any other types of three-dimensional forms and any combination thereof. For the purposes of this specification, the housing 100 will be described with reference to a generally cubic housing 100, but it is understood that the descriptions may also pertain to a housing 100 of any shape and/or form, and that the scope of the assembly 10 is not limited in any way by the shape or form of the housing 100.

In some embodiments, the housing 100 may comprise plastic, metal, wood, other types of polymers and/or materials and any combination thereof. The housing 100 may be solid so that the inner workings of the assembly 10 within the housing 100 are hidden from view, transparent so that the inner workings of the assembly 10 are visible, opaque or any combination thereof. In some embodiments, the housing 100 may have dimensions of about 6"×6"×6" while in other embodiments the housing 100 may be smaller (e.g., a mini size of about 2"×2"×2") or larger (e.g., a large size of about 8"×8"×8") and/or any size as desired.

In one exemplary embodiment hereof, the housing 100 includes a first outer surface 106 and a second outer surface 108. For example, the first outer surface 106 may include the front of the cubic housing 100 of FIG. 1, and the second outer surface 108 may include the top surface of the cubic housing 100. However, it is understood that the first and/or second outer surfaces 106, 108 may include any outer surface and/or any combination of outer surfaces of the housing 100. That is, the first outer surface 106 may include any one or more surfaces of the housing 100 and the second outer surface 108 may include any one or more surfaces of the housing. In some embodiments, the first and second surfaces 106, 108 may include the same one or more surfaces.

In one exemplary embodiment hereof, the first outer surface 106 (e.g., the front) includes one or more openings that pass from outside the housing 100 to the inner volume 104, and the second outer surface 108 (e.g., the top) includes an additional one or more openings that pass from outside the housing 100 to the inner volume 104. For example, as shown in FIG. 1, the front outer surface 106 may include three rows of three openings (a total of nine openings) designated as A1-P, A2-P, B1-P, B2-P, C1-P, C2-P, D1-P, D2-P and X (also referred to as front surface openings), and the top outer surface 108 may include three rows of three openings (a total of nine openings) designated as A1-P, A2-P, B1-P, B2-P, C1-P, C2-P, D1-P, D2-A and X-A (also referred to as top surface openings). In some embodiments, the front surface opening X may not pass from outside the housing 100 to the inner volume 104 but may instead be a symbolic opening.

In one exemplary embodiment hereof, the connection assembly 200 includes connectors 202 within the inner volume 104 leading between one or more of the front surface openings to one or more of the top surface openings. In some embodiments, each top surface opening includes a dedicated connector 202 that extends within the inner volume between the respective top surface opening and a particular front surface opening. For example, one connector 202 may extend between top surface opening B1-A and front surface opening B2-P.

Figure 2:
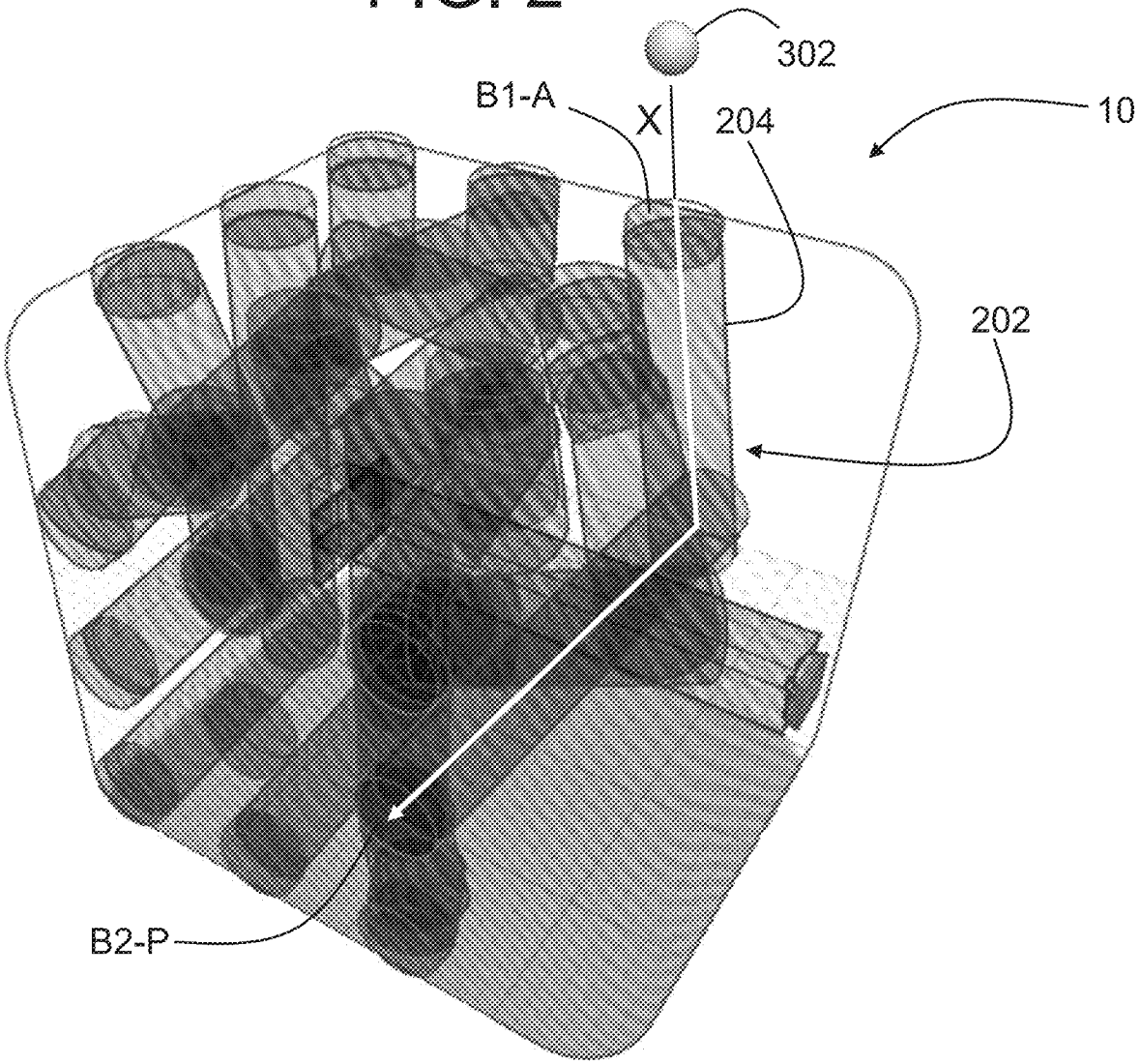

In one exemplary embodiment hereof as shown in FIG. 2, the connectors 202 include tubes 204 and the game pieces 300 include balls 302. However, it is understood that the connectors 202 may also include tracks, rails, slots, channels, grooves, other types of connectors and any combination thereof, and that game pieces 300 may include coins, disks, characters, cubes, other types of game pieces 300 and any combination thereof.

The tubes 204 may be dimensioned to accommodate the balls 302 (e.g., the inner diameter of the tubes 204 may be greater that the diameter of the balls 302) so that the balls 302 may pass through the tubes 204 without obstructions. The front surface openings and the top surface openings may also be dimensioned to accommodate the balls 302 (e.g., the diameter of the openings may be greater that the diameter of the balls 302) so that the balls 302, when placed through a top surface opening, may pass through the top surface opening, into and through the corresponding tube(s) 204, and out the front surface opening without obstruction. In some embodiments the diameters of the tubes 204 may be the same or similar to the diameters of the corresponding front or top surface openings. Using the example from above, a ball 302 placed in the top opening B1-A may pass through the opening, into and through the tube 204 connecting the top surface opening B1-A to the front surface opening B2-P, and out the front surface opening B2-P. This example is depicted by arrow X in FIG. 2.

In one exemplary embodiment hereof, the front surface openings include game piece holders 110 (best seen in FIG. 1) that catch and hold game pieces 300 (e.g., game balls 302) at and/or as they may emerge from the front surface openings after passing from corresponding top surface openings and connecting tubes 304. The game piece holders 110 may be formed as cups, lips, ridges, detents, pouches, retaining walls, posts, bars, other types of game piece holders 110 and any combination thereof. In some embodiments, a game piece 300 may be placed by the user into or at a holder 110 to be held by the holder 110.

In one exemplary embodiment hereof, respective connectors 202 (e.g. tubes 204) may lead from each top surface opening to a corresponding front surface openings as defined in Table 1. In this example, the connectors 202 are configured for a game of Tic Tac Toe in which the assembly 10 is programmed to never lose (that is, the assembly 10 may win or the game may end in a draw between the player and the assembly 10).

TABLE 1

| From Top Surface Opening | To Front Surface Opening |
|---|---|
| A1-A | A2-P |
| A2-A | A1-P |
| B1-A | B2-P |
| B2-A | B1-P |
| C1-A | C2-P |
| C2-A | C1-P |
| D1-A | D2-P |
| D2-A | D1-P |

In one exemplary embodiment hereof, Tic Tac Toe gameplay flow utilizing an assembly 10 configured with connecting tubes 204 as defined in Table 1 may proceed as follows:

Nine game balls 302 may be provided, with four game balls 302 being a first color (or including a first insignia and/or pattern or having other designating characteristic(s)) and five game balls being a second color (or including a second insignia and/or pattern or having other designating characteristic(s)). The first color game balls 302 may be designated as the player game balls 302-P and the second color game balls 302 may be designated as the assembly's game balls 302-A.

Figure 3:
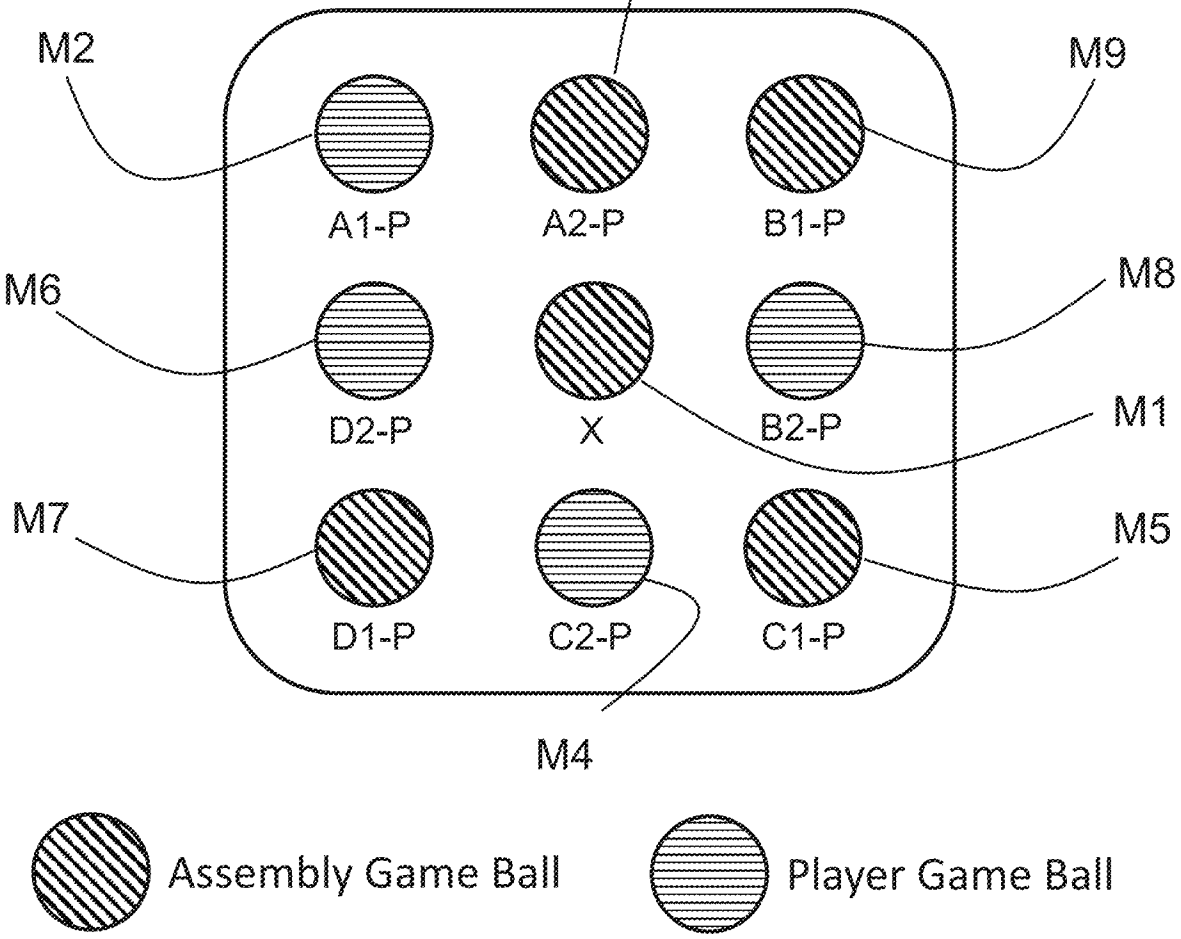
FIG. 3 shows aspects of an example single-player gameplay flow according to exemplary embodiments hereof.

The Tic Tac Toe game may begin with the assembly 10 making the first move into the X position on the front surface 106 of the assembly 10. To implement this move, the player places a first assembly game ball 302-A into the game ball holder 110 corresponding with the X position. This is depicted as M1 in FIG. 3.

Next, the player may make a move by placing a player game ball 302-P into a ball holder 110 corresponding to the position he/she wishes to play. For example, in this example, the player places a player game ball 302-P in the ball holder at opening A1-P depicted as M2.

In general, to implement additional moves by the assembly 10, the player places an assembly game ball 302-A into the top surface opening that corresponds to the front surface opening of the player's prior move.

Accordingly, to implement a second move by the assembly 10 in this example, because the player moved into front surface opening A1-P in his/her prior move (M2), the player places an assembly game ball 302-A into top surface opening A1-A. As shown in Table 1, a connecting tube 204 may connect top surface opening A1-A to front surface opening A2-P, so that the assembly game ball 302-A placed in top surface opening A1-A will be directed through the connecting assembly 200 and out of front surface opening A2-P where it will be held in place by the ball holder 110 configured with this opening. This is shown as M3.

Next, the player may wish to block the assembly 10 by placing a player game ball 302-P into the holder 110 at front surface opening C2-P as shown as M4.

Next, to implement a next move by the assembly 10, the player places an assembly game ball 302-A into the top surface opening that corresponds to the front surface opening of the player's prior move. In this example, because the player moved into front surface opening C2-P in his/her prior move (M4), the player places an assembly game ball 302-A into top surface opening C2-A. As shown in Table 1, a connecting tube 204 may connect top surface opening C2-A to front surface opening C1-P, so that the assembly game ball 302-A placed in top surface opening A1-A will be directed through the connection assembly 200 and out of front surface opening C1-P where it will be held in place by the ball holder 110 configured with this opening. This is shown as M5.

Next, the player may make a move by placing a player game ball 302-P into the holder 110 at front surface opening D2-P as shown as M6.

Next, to implement a next move by the assembly 10, the player places an assembly game ball 302-A into the top surface D2-A (corresponding to his/her prior move at D2-P). As shown in Table 1, a connecting tube 204 may connect top surface opening D2-A to front surface opening D1-P, so that the assembly game ball 302-A placed in top surface opening D2-A will be directed through the connecting assembly 200 and out of front surface opening D1-P where it will be held in place by the ball holder 110 configured with this opening. This is shown as M7.

Next, the player may make a move by placing a player game ball 302-P into the holder 110 at front surface opening B2-P as shown as M8.

Next, to implement a next move by the assembly 10, the player places an assembly game ball 302-A into the top surface B2-A (corresponding to his/her prior move at B2-P). As shown in Table 1, a connecting tube 204 may connect top surface opening B2-A to front surface opening B1-P, so that the assembly game ball 302-A placed in top surface opening B2-A will be directed through the connecting assembly 200 and out of front surface opening B1-P where it will be held in place by the ball holder 110 configured with this opening. This is shown as M9. With this move, it can be seen that the game assembly 10 has won the game of Tic Tac Toe by having three assembly game pieces 302-A in a row diagonally in front surface openings D1-P, X and B1-P.

It is understood that the gameplay moves described in the example above are meant for demonstration and that the player may make other moves during gameplay with the assembly 10 making other corresponding moves according to the programming (configurations) of the tubes 304 within the connection assembly 200. It is also understood that the scope of the assembly 10 is not limited in any way by the moves that the player may make during gameplay, nor by the corresponding moves that the assembly 10 may make in response to the players moves.

In one exemplary embodiment hereof, respective connectors 202 (e.g. tubes 204) may lead from each top surface opening to a corresponding front surface openings as shown in Table 2. In this example, the connectors 202 are configured for a game of Tic Tac Toe in which the assembly 10 is programmed to never win (that is, the assembly 10 may lose or the game may end in a draw between the player and the assembly 10).

TABLE 2

| From Top Surface Opening | To Front Surface Opening |
|---|---|
| A1-A | C1-P |
| A2-A | C2-P |
| B1-A | D1-P |
| B2-A | D2-P |
| C1-A | A1-P |
| C2-A | A2-P |
| D1-A | B1-P |
| D2-A | B2-P |

In this example, the gameplay moves of the player and/or of the assembly 10 may be performed as described above with relation to the example of Table 1.

It is understood by a person of ordinary skill in the art that the predefined configurations of the connectors 202 between associated top surface openings and front surface openings as shown in Table 1 and Table 2 are shown for demonstration, and that the connectors 202 (e.g., tubes 204) may be configured to lead from any top surface opening to any corresponding front surface opening depending on the game being played and the desired outcome of the game. It is also understood that the scope of the assembly 10 is not limited in any way by the configurations of the connectors 202 (e.g., tubes 204) in relation to the top surface openings and/or the front surface openings.

In one embodiment, the housing 100 may be opened or otherwise configured to allow access to and/or the removal of the connection assembly 200 within or from the housing 100. In some embodiments, the connection assembly 200 may be reconfigurable or interchangeable (e.g., by the owner of the assembly 10, the player(s) of the assembly, etc.) so that connectors 202 may be reconfigured to lead between different top surface openings and front surface openings. In this way, the algorithms defined by the connection assembly 200 may be changed as desired.

In one exemplary embodiment hereof, the assembly 10 may be configured to provide the game of Tic Tac Toe generalized to higher dimensions and played on an m×n grid (as opposed to a 3×3 grid). In this case, the first and second surfaces may include openings forming an m×n grid and the connection assembly 200 may be configured to connect respective first and second surface openings accordingly (apply the algorithms). Example games of this sort may include (without limitation), Qubic, Gomoku, Order and Chaos, Pente and other types of games.

In other embodiments, the assembly 10 may be configured to provide a $n^d$ game (also referred to as a $n^k$ game) and may be played using an assembly 10 formed as a hypercube.

In one exemplary embodiment hereof, two or more players may play one or more types of games utilizing one or more assemblies 10.

In one example, two players may play a strategy version of the Tic Tac Toe game with each player utilizing their own individual assembly 10. In this example, each player may receive nine game pieces 300, each with a number from one to nine on its face (or elsewhere). The first player's game pieces 300 may include an "X" on the side opposite the numbers (or elsewhere) and the second player's game pieces may include a "O" on the side opposite the numbers (or elsewhere). Other insignia may also be used.

Figure 4:
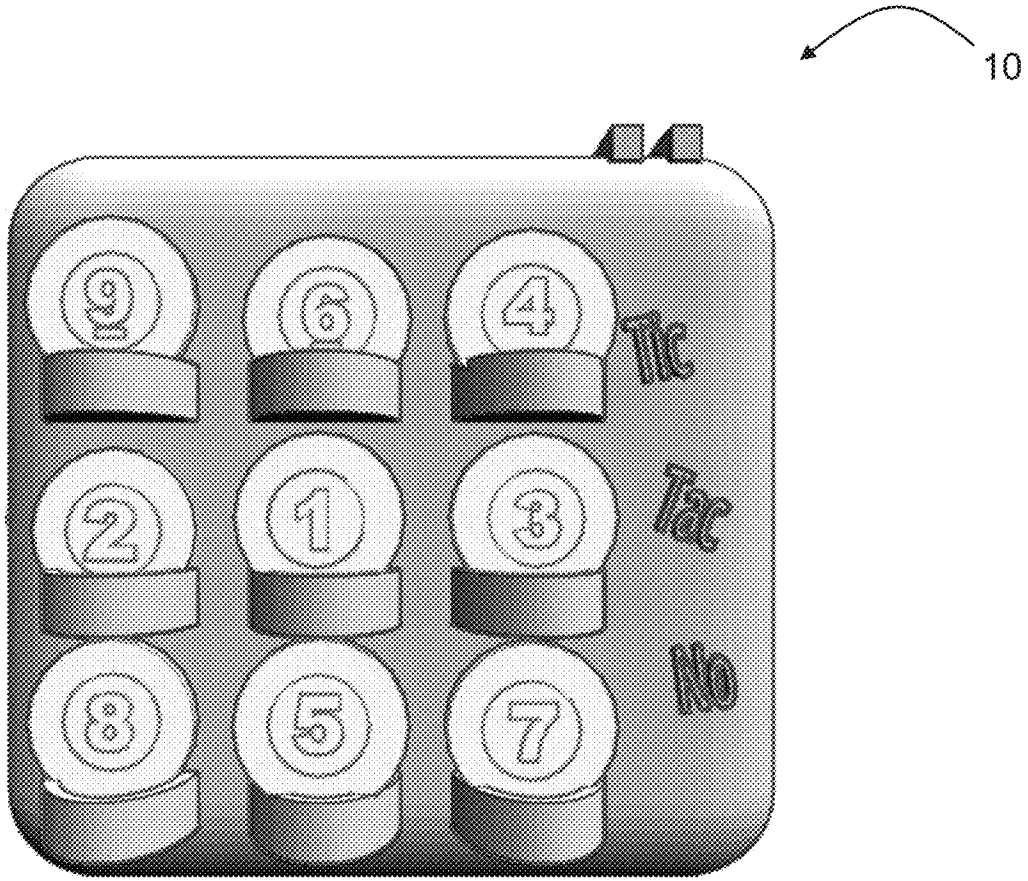
FIG. 4 shows aspects of an example multi-player game according to exemplary embodiments hereof.

In a first step of the gameplay, each player may predetermine his/her Tic Tac Toe moves by placing their game pieces in the front surface ball holders 110 their respective assembly 10. The front surface opening position in which each game piece is positioned may represent the move that the game piece 300 may represent when it is played, and with the number on each game piece 300 representing the order that the game piece 300 will be played. An example of this is shown in FIG. 4. At this stage of the gameplay, the players may conceal from each other the positions in which they may place their game pieces 300. Note that the connection assemblies 200 for either of the assemblies 10 may be configured in any way, including being configured to always win, always lose and/or otherwise.

Next, the players may reveal their predetermined plays by turning around their assemblies 10 and exclaiming "Tic Tac No" at the same time. The players play then may play out their sequences on a Tic Tac Toe grid, alternating from player to player, each one placing an "X" or an "O" according to the sequence they pre-chose and skipping any obstructed grid that the competing player may have filled in a prior move. This sequence may continue until the first or second player wins or there is a draw between the players.

In some embodiments, the assembly 10 includes an accessible storage area (e.g., within the inner volume 104 that may be used to store the game pieces 300 when not in use. The storage area may include a cavity or other type of volume large enough to hold the game pieces 300. The storage area may be closed (e.g., with a closing door, cover or such) to hold the game pieces 300 safe and secure when not in use and subsequently opened to retrieve the pieces 300 to play the games.

Where a process is described herein, those of ordinary skill in the art will appreciate that the process may operate without any user intervention. In another embodiment, the process includes some human intervention (e.g., a step is performed by or with the assistance of a human).

It is understood that any aspect and/or detail of any embodiment described herein or otherwise may be combined with any other aspect and/or detail of any other embodiment described herein or otherwise to form an additional embodiment that also is within the scope of the assembly 10.

As used herein, including in the claims, the phrase "at least some" means "one or more," and includes the case of only one. Thus, e.g., the phrase "at least some ABCs" means "one or more ABCs", and includes the case of only one ABC.

As used herein, including in the claims, term "at least one" should be understood as meaning "one or more", and therefore includes both embodiments that include one or multiple components. Furthermore, dependent claims that refer to independent claims that describe features with "at least one" have the same meaning, both when the feature is referred to as "the" and "the at least one".

As used in this description, the term "portion" means some or all. So, for example, "A portion of X" may include some of "X" or all of "X". In the context of a conversation, the term "portion" means some or all of the conversation.

As used herein, including in the claims, the phrase "using" means "using at least," and is not exclusive. Thus, e.g., the phrase "using X" means "using at least X." Unless specifically stated by use of the word "only", the phrase "using X" does not mean "using only X."

As used herein, including in the claims, the phrase "based on" means "based in part on" or "based, at least in part, on," and is not exclusive. Thus, e.g., the phrase "based on factor X" means "based in part on factor X" or "based, at least in part, on factor X." Unless specifically stated by use of the word "only", the phrase "based on X" does not mean "based only on X."

In general, as used herein, including in the claims, unless the word "only" is specifically used in a phrase, it should not be read into that phrase.

As used herein, including in the claims, the phrase "distinct" means "at least partially distinct." Unless specifically stated, distinct does not mean fully distinct. Thus, e.g., the phrase, "X is distinct from Y" means that "X is at least partially distinct from Y," and does not mean that "X is fully distinct from Y." Thus, as used herein, including in the claims, the phrase "X is distinct from Y" means that X differs from Y in at least some way.

It should be appreciated that the words "first," "second," and so on, in the description and claims, are used to distinguish or identify, and not to show a serial or numerical limitation. Similarly, letter labels (e.g., "(A)", "(B)", "(C)", and so on, or "(a)", "(b)", and so on) and/or numbers (e.g., "(i)", "(ii)", and so on) are used to assist in readability and to help distinguish and/or identify, and are not intended to be otherwise limiting or to impose or imply any serial or numerical limitations or orderings. Similarly, words such as "particular," "specific," "certain," and "given," in the description and claims, if used, are to distinguish or identify, and are not intended to be otherwise limiting.

As used herein, including in the claims, the terms "multiple" and "plurality" mean "two or more," and include the case of "two." Thus, e.g., the phrase "multiple ABCs," means "two or more ABCs," and includes "two ABCs." Similarly, e.g., the phrase "multiple PQRs," means "two or more PQRs," and includes "two PQRs."

The present invention also covers the exact terms, features, values and ranges, etc. in case these terms, features, values and ranges etc. are used in conjunction with terms such as about, around, generally, substantially, essentially, at least etc. (i.e., "about 3" or "approximately 3" shall also cover exactly 3 or "substantially constant" shall also cover exactly constant).

As used herein, including in the claims, singular forms of terms are to be construed as also including the plural form and vice versa, unless the context indicates otherwise. Thus, it should be noted that as used herein, the singular forms "a," "an," and "the" include plural references unless the context clearly dictates otherwise.

Throughout the description and claims, the terms "comprise", "including", "having", and "contain" and their variations should be understood as meaning "including but not limited to", and are not intended to exclude other components unless specifically so stated.

It will be appreciated that variations to the embodiments of the invention can be made while still falling within the scope of the invention. Alternative features serving the same, equivalent or similar purpose can replace features disclosed in the specification, unless stated otherwise. Thus, unless stated otherwise, each feature disclosed represents one example of a generic series of equivalent or similar features.

The present invention also covers the exact terms, features, values and ranges, etc. in case these terms, features, values and ranges etc. are used in conjunction with terms such as about, around, generally, substantially, essentially, at least etc. (i.e., "about 3" shall also cover exactly 3 or "substantially constant" shall also cover exactly constant).

Use of exemplary language, such as "for instance", "such as", "for example" ("e.g.,") and the like, is merely intended to better illustrate the invention and does not indicate a limitation on the scope of the invention unless specifically so claimed.

While the invention has been described in connection with what is presently considered to be the most practical and preferred embodiments, it is to be understood that the invention is not to be limited to the disclosed embodiment, but on the contrary, is intended to cover various modifications and equivalent arrangements included within the spirit and scope of the appended claims.

What is claimed is:

1. A game assembly comprising:

a housing with a first outer surface, a second outer surface and an inner volume defined by the first and second outer surfaces;

a plurality of first surface openings in the first surface, each first surface opening passing through the first outer surface and into the inner volume;

a plurality of second surface openings in the second surface, each second surface opening passing through the second outer surface and into the inner volume;

wherein the plurality of first surface openings includes a total of eight first surface openings arranged in a pattern comprising three first surface rows of first surface openings, and/or wherein the plurality of second surface openings includes a total of eight second surface openings arranged in a pattern comprising three second surface rows of second surface openings;

wherein three first surface openings are included in a first surface first row, two first surface openings are included in a first surface second row, and three first surface openings are included in a first surface third row, and/or wherein three second surface openings are included in a second surface first row, two second surface openings are included in a second surface second row, and three second surface openings are included in a second surface third row;

a plurality of connectors, each connector extending between one first surface opening and one second surface opening;

a plurality of game pieces adapted to pass through any of the plurality of first surface openings, any of the plurality of second surface openings and any of the plurality of connectors;

wherein the placement of a game piece into one of the plurality of first surface openings causes the game piece to travel through one of the plurality of connectors to one of the plurality of second surface openings.

2. The game assembly of claim 1 wherein the plurality of connectors are configured within the inner volume.

3. The game assembly of claim 1 wherein the connectors are selected from the group: tubes, tracks, rails, channels, and grooves.

4. The game assembly of claim 1 wherein the game pieces are selected from the group: balls, coins, and discs.

5. The game assembly of claim 1 wherein the plurality of game pieces includes a total of eight game pieces, with three of the total of eight game pieces including a first color, first pattern or first insignia, and with four of the total of eight game pieces including a second color, second pattern or second insignia.

6. The game assembly of claim 1 wherein the plurality of first surface openings includes a total of eight first surface openings and/or the plurality of second surface openings includes a total of eight second surface openings.

7. The game assembly of claim 1 wherein the plurality of connectors includes a total of eight connectors.

8. The game assembly of claim 1 further comprising a plurality of game piece holders, each game piece holder configured with a second surface opening.

9. The game assembly of claim 1 comprising each of the first and second rows of each of the first and second surface openings, wherein the first surface first row includes a first surface first opening and a first surface second opening, and the second surface second row includes a second surface first opening and a second surface second opening, and wherein a first connector extends between the first surface first opening and the second surface second opening and a second connector extends between the first surface second opening and the second surface first opening.

10. The game assembly of claim 1 wherein the housing includes a hexahedron.

11. The game assembly of claim 1 further comprising a plurality of game piece holders, each game piece holder configured with a second surface opening.

12. A game assembly of claim 9 comprising:

a housing with a first outer surface, a second outer surface and an inner volume defined by the first and second outer surfaces;

a plurality of first surface openings in the first surface, each first surface opening passing through the first outer surface and into the inner volume;

a plurality of second surface openings in the second surface, each second surface opening passing through the second outer surface and into the inner volume;

wherein the plurality of first surface openings includes a total of eight first surface openings arranged in a pattern comprising three first surface columns of first surface openings, and/or wherein the plurality of second surface openings includes a total of eight second surface openings arranged in a pattern comprising three second surface columns of second surface openings;

wherein three first surface openings are included in a first surface first column, two first surface openings are included in a first surface second column, and three first surface openings included in a first surface third column and/or three second surface openings are included in a second surface first column, two second surface openings are included in a second surface second column, and three second surface openings are included in a second surface third column;

a plurality of connectors, each connector extending between one first surface opening and one second surface opening;

a plurality of game pieces adapted to pass through any of the plurality of first surface openings, any of the plurality of second surface openings and any of the plurality of connectors;

wherein the placement of a game piece into one of the plurality of first surface openings causes the game piece to travel through one of the plurality of connectors to one of the plurality of second surface openings.

13. A game assembly comprising:

a housing with a first outer surface, a second outer surface and an inner volume defined by the first and second outer surfaces;

a first, second, third, fourth, fifth, sixth, seventh and eighth first surface openings, each first surface opening passing through the first outer surface and into the inner volume;

a first, second, third, fourth, fifth, sixth, seventh and eighth second surface openings, each first surface opening passing through the second outer surface and into the inner volume;

a first connector extending between the first first surface opening and the first second surface opening, a second connector extending between the second first surface opening and the second second surface opening, a third connector extending between the third first surface opening and the third second surface opening, a fourth connector extending between the fourth first surface opening and the fourth second surface opening, a fifth connector extending between the fifth first surface opening and the fifth second surface opening, a sixth connector extending between the sixth first surface opening and the sixth second surface opening, a seventh connector extending between the seventh first surface opening and the seventh second surface opening, and a eighth connector extending between the eighth first surface opening and the eighth second surface opening;

a plurality of game pieces adapted to pass through any of the plurality of first surface openings, any of the plurality of second surface openings and any of the plurality of connectors;

wherein the placement of a game piece into one of the plurality of first surface openings causes the game piece to travel through one of the plurality of connectors to one of the plurality of second surface openings.

14. The game assembly of claim 13 wherein the plurality of connectors are configured within the inner volume.

15. The game assembly of claim 13 wherein the connectors are selected from the group: tubes, tracks, rails, channels, and grooves.

16. The game assembly of claim 13 wherein the game pieces are selected from the group: balls, coins, and discs.

17. The game assembly of claim 13 wherein the plurality of game pieces includes a total of eight game pieces, with three of the total of eight game pieces including a first color, first pattern or first insignia, and with four of the total of eight game pieces including a second color, second pattern or second insignia.

18. The game assembly of claim 13 wherein the first, second and third first surface openings are configured in a first row of first surface openings, the fourth and fifth first surface openings are configured in a second row of first surface openings, and the sixth, seventh and eighth first surface openings are configured in a third row of first surface openings.

* * * * *